United States Patent [19]

Tommasino

[11] 3,949,983

[45] Apr. 13, 1976

[54] PRONE BOARD FOR PEDIATRIC PHYSICAL THERAPY

[75] Inventor: Ralph P. Tommasino, North Merrick, N.Y.

[73] Assignee: The Raymond Lee Organization, Inc., a part interest

[22] Filed: Mar. 10, 1975

[21] Appl. No.: 556,724

[52] U.S. Cl. ..... 272/57 R; 269/328

[51] Int. Cl.[2] ..... A63B 23/00

[58] Field of Search ..... 272/57 R, 58; 128/25 R, 128/74; 297/174, 390; 248/118, 158, 161; 5/60, 92; 269/322, 323, 328

[56] References Cited

UNITED STATES PATENTS

| | | | |
|---|---|---|---|
| 309,678 | 12/1884 | Aubin | 272/58 |
| 2,228,793 | 1/1941 | Swofford | 269/322 |
| 3,754,787 | 8/1973 | Garber | 297/390 |
| 3,790,164 | 2/1974 | Flanigan | 272/57 R |

FOREIGN PATENTS OR APPLICATIONS

| | | | |
|---|---|---|---|
| 1,291,572 | 1962 | France | 269/328 |

*Primary Examiner*—Richard J. Apley
*Assistant Examiner*—Harry G. Strappello

[57] ABSTRACT

A base supports an elongated support strut that can be inclined at any of a number of preselected upward and forward inclinations and supported at the selected inclination by an elongated prop. The support strut supports a foot rest, a knee pad and a chest pad along its length, with the chest pad being disposed at the top of the strut, the foot rest near the bottom, and the knee pad at an intermediate location between the chest pad and foot rest. The foot rest and knee pad can be moved up and down along the strut and fixed at any one of a plurality of positions thereupon. A flat feeding tray is hingedly attached to the top of the strut and can be set at any inclination between a maximum inclination and a minimum inclination with respect to the strut.

4 Claims, 3 Drawing Figures

FIG. 1
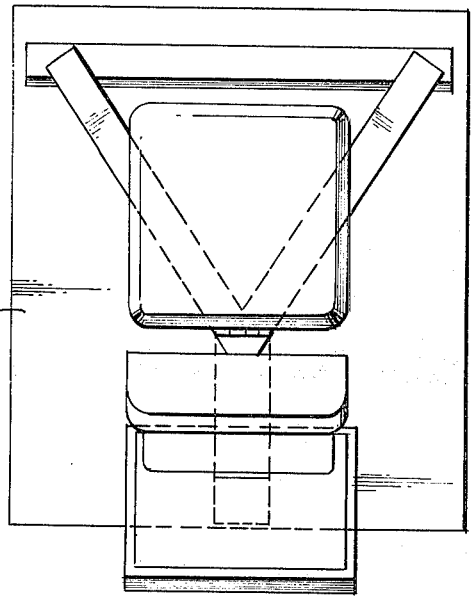
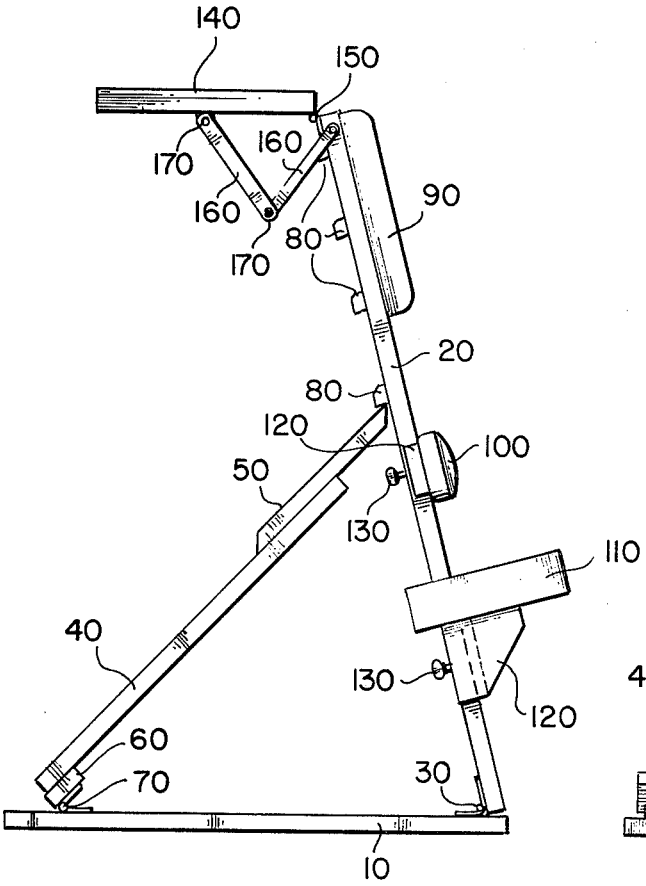
FIG. 3
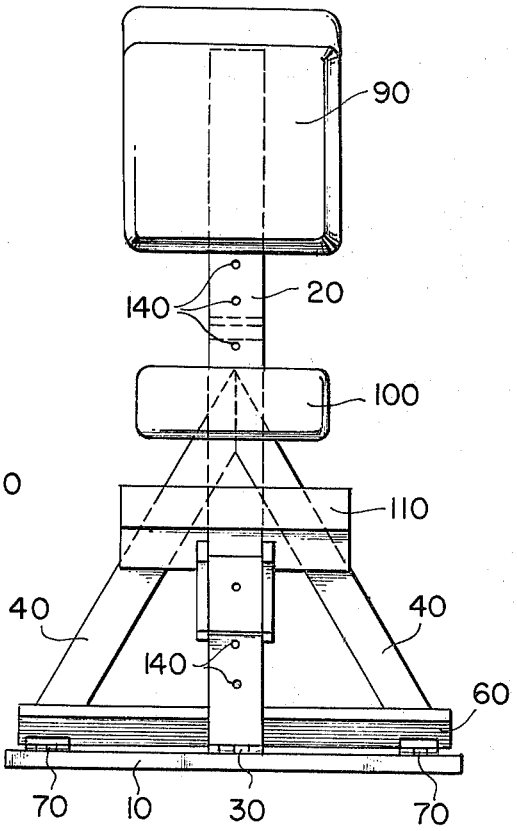
FIG. 2

PRONE BOARD FOR PEDIATRIC PHYSICAL THERAPY

SUMMARY OF THE INVENTION

The object of the invention is to provide an exercise board that can support a child in a prone position for various exercises that are performed in programs for physical therapy.

Thus, an inclined support strut is fitted with a foot rest and a chest pad. The foot rest is disposed near the bottom of the strut and the chest pad is disposed at the top. The strut always extends upwardly and forwardly, but its angle of inclination with respect to a horizontal base to which it is hingedly attached is variable.

When a child's feet are placed upon the foot rest, the chest of the child will abut the chest pad. A knee pad and feeding tray may be attached to the support strut, and these elements, along with the foot rest, may be adjustable to fit differently sized children.

BRIEF DESCRIPTION OF THE DRAWINGS

FIG. 1 is a top view of the invention.
FIG. 2 is a front view of the invention.
FIG. 3 is a side view of the invention.

DETAILED DESCRIPTION OF PREFERRED EMBODIMENTS

A horizontal rectangular base 10 supports an elongated and upwardly and forwardly inclined support strut 20 that is attached to the rear edge of the base by hinge 30. The inclination of the strut is set by a prop formed by two rearwardly, upwardly and inwardly inclined boards 40 that are connected to an elongated extension 50 at their upper ends. The lower ends of the boards are connected to board 60 that is attached to the rear edge of the base by two like hinges 70, allowing the prop to be pivoted to various inclinations. The extension may be placed under any one of a plurality of blocks 80 that are disposed along the front of the strut, to determine the strut's inclination. To the top of the strut, on its rear, is secured a rectangular chest pad 90. Directly below the pad 90 on the strut is knee pad 100, and disposed below the pad 100 is foot rest 110. These latter two elements may be moved up and down along the strut because they are equipped with supports 120 that encircle the sides and front of the strut and that support machine nuts (not shown) in their structures. Wing-tipped machine nuts 130 are passed rearwardly through holes 140 in the strut to engage corresponding nuts in the structures of the supports. Thus, the pad 100 and foot rest can be moved to fit children of varying sizes, and neither can tilt to either side with respect to the strut because of the structure of the supports.

The foot rest is not merely a flat surface, but a surface surrounded on its sides and rear by a peripheral wall that prevents the feet of the children from slipping off the foot rest during therapy.

The back edge of a flat rectangular feeding tray 140 is attached to the top of the strut by hinge 150, and supported in various orientations by two opposed like sets of hinged link arms 160 that are each connected between the bottom of the tray and a corresponding side of the strut. The tray is flat but has molding about one inch high disposed around its edges. The arms have enough friction in their hinges 170 to keep the tray supported anywhere between a state of minimum inclination with respect to the strut (in which the tops of pad 90 and the tray are coplanar) and a state of maximum inclination with respect to the strut (in which the tops of the tray and pad 90 are generally parallel).

While the invention has been described with detailed reference to the drawings, the protection sought is to be limited only by the terms of the claims which follow.

I claim:

1. An exercise board for use in pediatric physical therapy, said board comprising:

a horizontal base;

an elongated support strut hingedly attached to the rear edge of the base and extending upwardly and forwardly therefrom;

means for setting the inclination of the support strut to any one of a plurality of pre-selected values;

a feeding tray hingedly attached to the top end of the support strut and adjustable to be generally horizontal for all orientations of said strut, said tray having a central flat surface with a raised peripheral border so as to retain dishes and the like on the central surface;

a foot rest attached to the support strut near its lower end;

a chest pad attached to the support strut at its top end in a manner that the chest pad will abut the chest of a child whose feet are placed upon the foot rest; and a knee pad disposed upon the support strut between the foot rest and the chest pad for protecting the knees of a child whose feet have been placed upon the foot rest and whose chest abuts the chest pad.

2. The device of claim 1 wherein the foot rest and knee pad are slidably attached to the support strut and may be moved up and down thereon to any one of a plurality of preselected positions and fixed at that position.

3. The device of claim 2 wherein the feeding tray may be set at any inclination between a position of maximum inclination and a position of minimum inclination with respect to the support strut.

4. The device of claim 3 wherein the means is characterized by an elongated prop that is hingedly attached to the front edge of the base and that extends upwardly and rearwardly therefrom to any one of a plurality of positions along the front of the support bar.

* * * * *